United States Patent [19]

Holl et al.

[11] Patent Number: 5,027,704

[45] Date of Patent: Jul. 2, 1991

[54] DRIVE MECHANISM FOR AXIALLY RECIPROCATING THE INTERMEDIATE ROLLERS IN AN OFFSET PRINTING PRESS

[75] Inventors: Roland Holl, Weiterstadt; Herbert Rebel, Rodgau; Peter Hummel, Offenbach am Main, all of Fed. Rep. of Germany

[73] Assignee: MAN Roland Druckmaschinen AG, Fed. Rep. of Germany

[21] Appl. No.: 492,534

[22] Filed: Mar. 12, 1990

[30] Foreign Application Priority Data

Mar. 13, 1989 [DE] Fed. Rep. of Germany ..... 3908044

[51] Int. Cl.[5] ..... B41F 7/40; B41F 31/30; B41L 27/32

[52] U.S. Cl. ..... 101/148; 101/349; 101/DIG. 38

[58] Field of Search ..... 101/349, 350, 351, 352, 101/363, 148, 207, 208, 209, 210, DIG. 38, 247, 216, 355-357, 348

[56] References Cited

U.S. PATENT DOCUMENTS 4,385,559 5/1983 Jarach ..... 101/352 X
4,458,592 7/1984 Junghans ..... 101/DIG. 38
4,620,481 11/1986 Steiner ..... 101/350

*Primary Examiner*—J. Reed Fisher
*Attorney, Agent, or Firm*—Leydig, Voit & Mayer

[57] ABSTRACT

To provide a drive mechanism for axially reciprocating the first roller or the first and second roller of an intermediate roller pair adapted to be selectively associated with the first ink spreader roller of an inking unit or with the final applicator roller of a damping unit of a combined damping and inking unit of an offset printing press, a stroke coupling for the spindle of the first intermediate roller with the first ink spreader roller is provided. This stroke coupling is transmitted to the spindle of the second intermediate roller only when both intermediate rollers are in engagement with the damping roller, whereas in the position in which the second intermediate roller interconnects the damping unit and the inking unit, the spindle of the latter roller is secured axially and separated from the stroke coupling.

4 Claims, 6 Drawing Sheets

DRIVE MECHANISM FOR AXIALLY RECIPROCATING THE INTERMEDIATE ROLLERS IN AN OFFSET PRINTING PRESS

FIELD OF THE INVENTION

The present invention relates generally to a drive mechanism in offset printing presses for axially reciprocating the first roller or the first and second rollers of an intermediate roller pair of a combined damping and inking unit.

BACKGROUND OF THE INVENTION

A change-over device for an intermediate damping roller in an offset printing press is disclosed in our copending U.S. Pat. Application Ser. No.491,507, filed Mar. 12, 1990. When the two intermediate rollers of a roller pair are at their first setting as connecting rollers between the damping unit and the inking unit, the device has four nips in relation to the first inking roller, the second roller being effective as a storage roller and smoothing roller on the first ink spreader roller. At a second setting, in which the rollers both engage with the damping roller, because of the separation of the damping unit from the inking unit, the two rider rollers on the damping roller can control mottling caused by the blank parts of the plate cylinder. When a third roller is introduced into the bearing socket of the second roller, communication between the inking unit and the damping unit is restored without impairment of the operation of the two rollers. Since there are three cooperating rollers, the latter setting leads to very rapid achievement of equilibrium between the ink and the damping agent and is also highly effective against mottling in both the inking unit and the damping unit.

OBJECTS AND SUMMARY OF THE INVENTION

It is the primary object of the present invention to ensure that when the two intermediate rollers are at their first setting as connecting rollers between the damping unit and the inking unit, only the first roller is operative as a spreader roller whereas at the second setting, in which the rollers both engage with the damping roller, both rollers are effective as spreader rollers and the drive mechanism producing the axial reciprocation can be derived from the ink spreader roller with a stepped-down stroke.

In carrying out the present invention, a stroke coupling for the spindle of the first intermediate roller with the first ink spreader roller is provided. This stroke coupling is transmitted to the spindle of the second intermediate roller only when both intermediate rollers are in engagement with the damping roller, whereas in the position in which the second intermediate roller interconnects the damping unit and the inking unit, the spindle of the latter roller is secured axially and separated from the stroke coupling.

The advantage of the invention resides in optimum spreading in the nips of the two rollers, such nips being present in dependence upon the setting. Deriving the axial reciprocation from the traversing drive of the ink unit obviates disturbances which would arise with a separate traversing drive for the two rollers.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
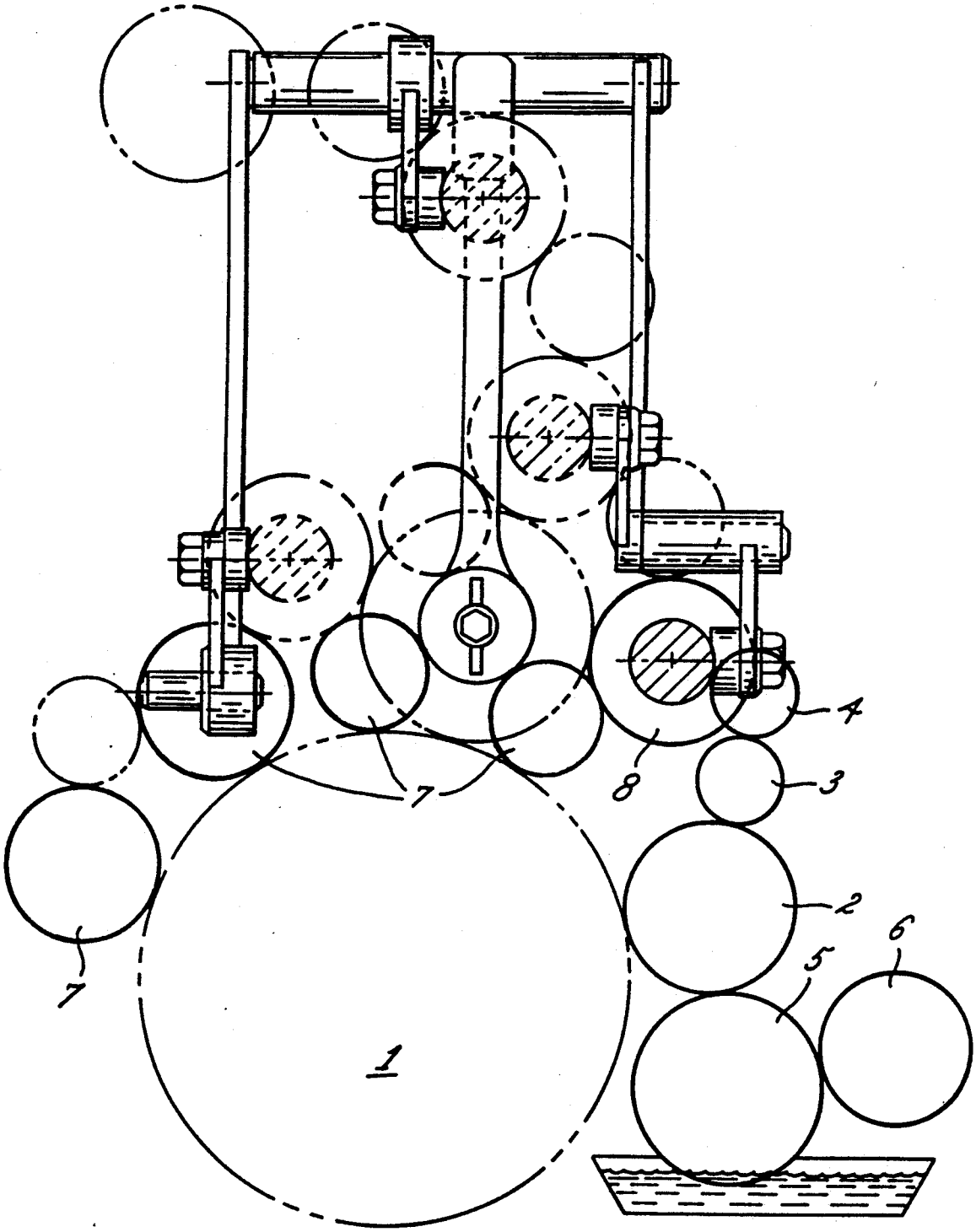
FIG. 1 is a diagrammatic side view of the spreading drive of a damping and inking unit of an offset printing press.
Figure 2:
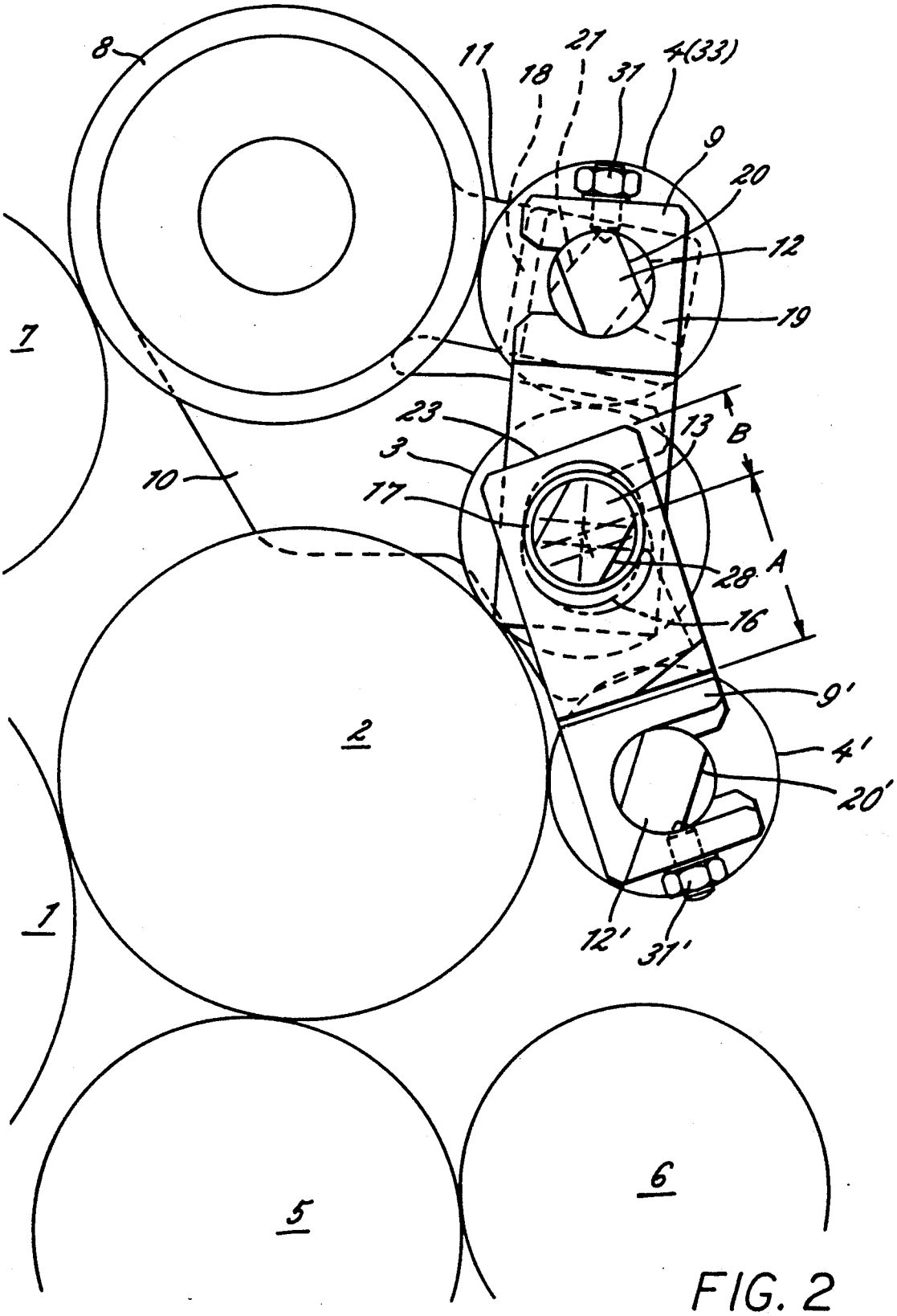
FIG. 2 is a side view of the combined damping and inking unit with the bearing levers for the intermediate rollers which are adapted to be changed over and which can be driven with lateral traversing.
Figure 3:
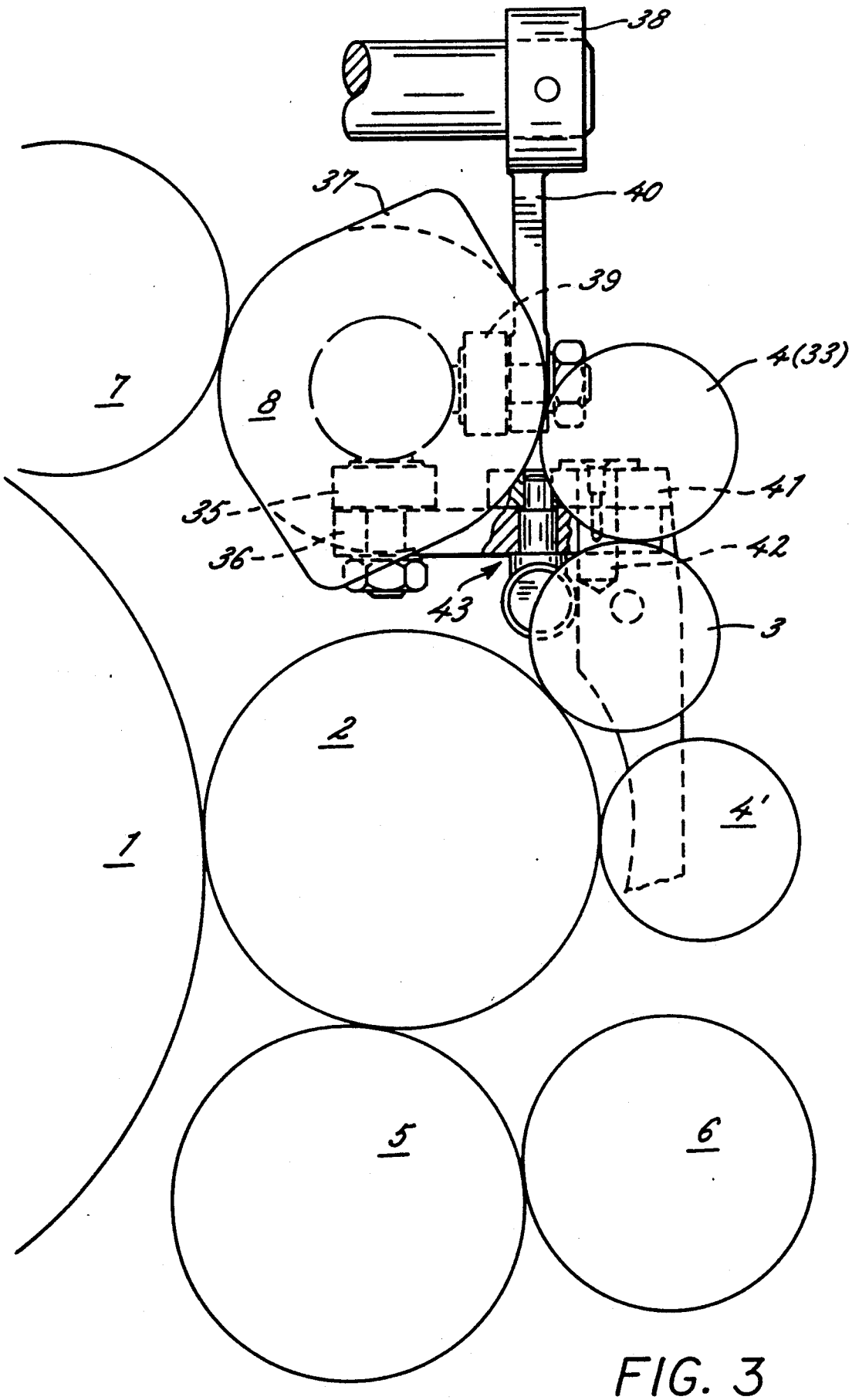
FIG. 3 is a side view of the stroke coupling of the first intermediate roller with the spreading drive of the ink spreader roller.
Figure 4:
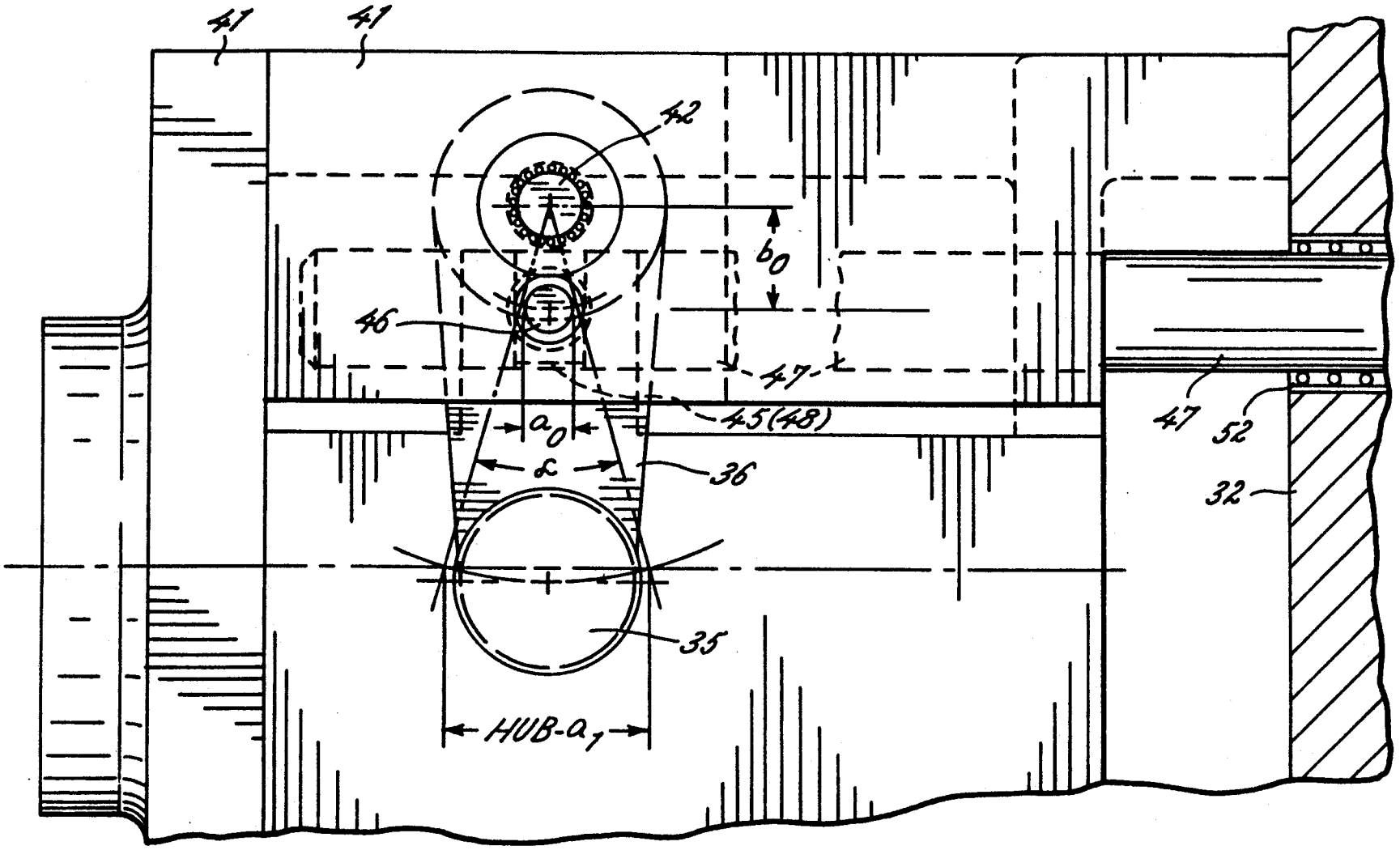
FIG. 4 is a view, substantially as seen in the direction X of FIG. 3, of the transmission casing of the damping unit.
Figure 5:
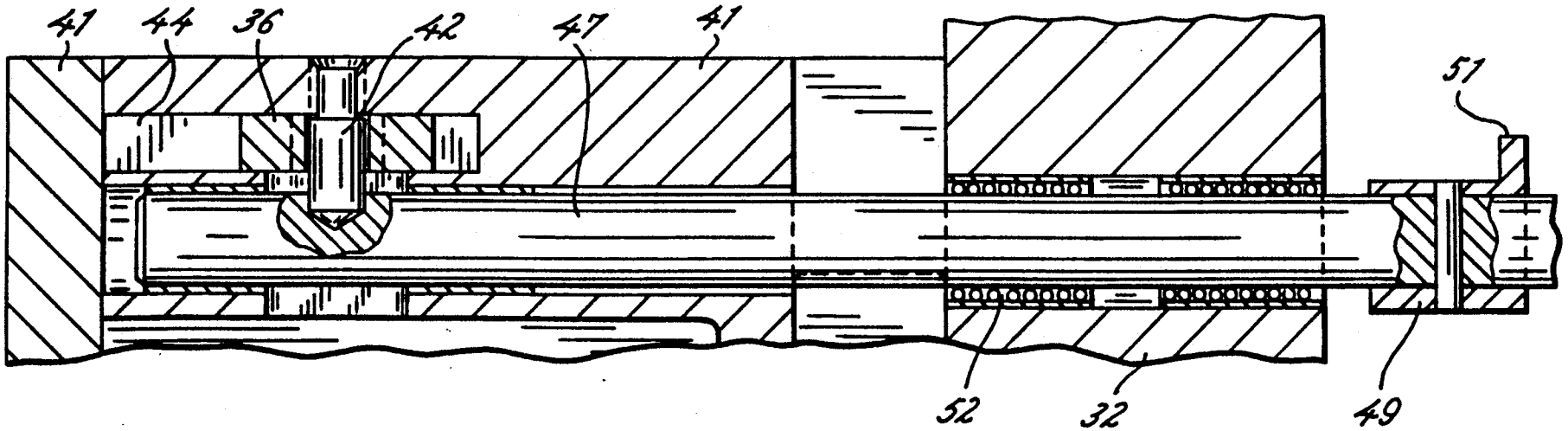
FIG. 5 shows a portion of the top part of the transmission casing of the damping unit with parts of the stroke coupling between the ink spreader roller and the first intermediate roller.
Figure 6:
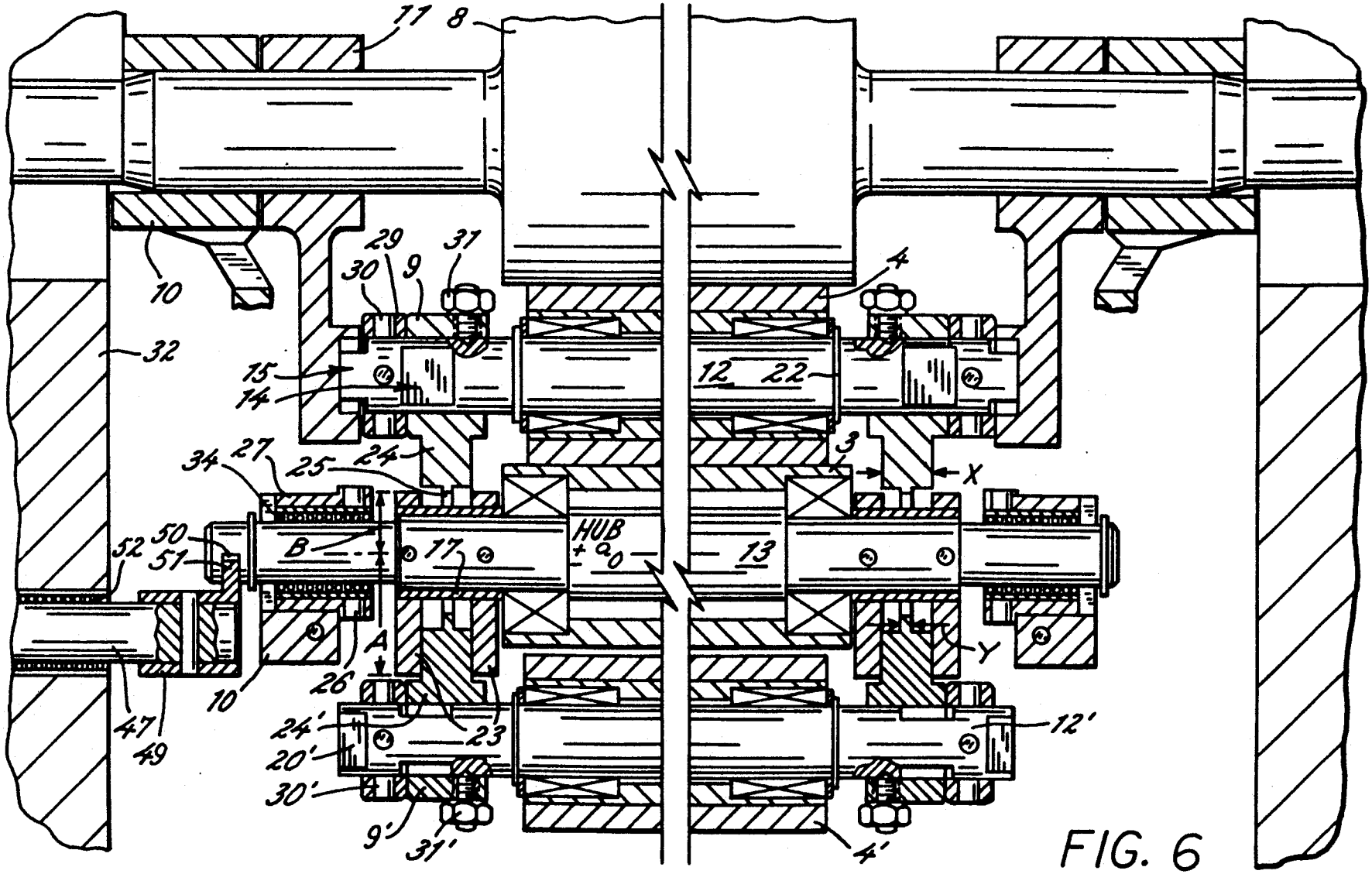
FIG. 6 is a front elevation view, partly in section, of the combined damping and inking unit of FIG. 2 with parts of the stroke coupling of the first intermediate roller or first and second intermediate rollers with the first ink spreader roller.

Turning now to the drawings and particularly FIGS. 1, 2 and 6, the device illustrated comprises a plate cylinder 1 mounted by means of journals at each end in the side walls 32 of a printing press. In a manner which is known, and not further shown here, the journals are driven by gearwheels which are disposed outside the side walls 32 and which are, in turn, driven by the main drive of the press. Damping liquid is supplied from a water box into which a water box roller 5 dips. The thickness of the damping liquid is adjusted by means of a dispensing roller 6 in accordance with conventional practice.

The liquid damping unit including rollers 2, 5 and 6, therefore guides the damping liquid directly on to the plate on the cylinder 1 over a very short path, thus ensuring that evaporation of the damping agent is reduced. The drive of the damping unit rollers and inking unit rollers is known and will not be further described. All the damping unit rollers 2, 5 and 6 and the rollers 3 and 4 between the damping unit and the inking unit are adjustable relatively to one another and the adjustment can in known manner take the form, for example, of the rollers being mounted on adjustable eccentric sleeves or of arranging adjusting screws and/or of the provision of springs or of bearing levers which receive the rolls.

Similar considerations apply to the necessary shutdown of printing or night stop of the rollers and appropriate means are provided for separating the rollers from one another. Such means do not form part of the present invention.

The journal at each end of whichever ink spreader roller 8 is first as considered in the direction of plate cylinder rotation has mounted on it a first bearing lever 10 which is pivotable around the center of the ink spreader roller 8 and which bears axially, for example, on the press side walls 32. Internally and adjacent to the bearing lever 10, a second bearing lever 11, pivotable around the center of the ink spreader roller 8, is mounted at each end thereof on the respective journal with axial support. The other end of the lever 11 receives the end of the spindle 12 of the second intermediate roller 4 of the two intermediate rollers 3 and 4, with the interposition of a roller lock 15, in a bearing socket open on one side. The bearing lock 15 is embodied by a part 21 of spindle 12 flattened on two sides and being introducible through a slot 19 into the bearing socket. The spindle 12 is turned to secure both itself and the second roller 4 in the bearing socket of the lever 11. The shell of the second roller 4 is rotatably mounted on the spindle 12 with the interposition of rolling bearing means as is well known.

A pair of pivoting levers 9 are also pivotally connected, one near each end face of the first roller 3, on a sleeve 17 on a coaxial part of the spindle 13 of the first intermediate roller 3. Each lever 9 also receives the top intermediate roller 4 at its top end in a bearing socket which is open on one side, with the interposition of a roller lock 14. The roller lock 14 takes the form of a part 30 of the spindle 12 flattened on two sides and being introducible through a slot 18 into the bearing socket. The slots 18 and 19 and the corresponding flattened parts 20 and 21 are angularly offset from one another so that the spindle 12 when released from the lever 11 still remains locked in the lever 9 so that the second intermediate roller 4 can be changed over, but only when the same is in its changed-over position can it be unlocked and, therefore, removed by being turned after the release of a pressing element such as a set screw 31. The set screw 31 also secures the spindle 12 on the lever 9 when the roller lock 15 is engaged.

To facilitate locking and unlocking the spindle 12 by rotating the same, an adjusting ring 29, which is pinned to the spindle 12 and which is formed with a bore 30, is disposed between the levers 9 and 11. Additionally, when the second intermediate roller 4 is in the first position, interconnecting the inking unit and the damping unit, the axial position of the levers 10 and 11 is fixed relatively to the press side walls 32.

To change over the second intermediate roller 4 —i.e., to separate the inking unit and damping unit from one another—the roller lock 15 is opened by turning the spindle 12 through approximately 90° so as to unlock the second roller 4. The lever 9 has guide means 16 and 17, in the form of a coaxial sleeve 17 on a part of the spindle 13 and of a slot 16 in the lever 9 so positioned and dimensioned that, when the intermediate rollers 3 and 4 are in contact with one another, the top bearing or contact surface of the slot 16 is disposed on the sleeve 17. Also, the sleeve 17 is effective as an axial spacing or securing sleeve for the inner races (indicated diagrammatically in the drawings by a cross) of the rolling bearings of the first intermediate roller 3 on the spindle 13. Securing rings 22 provide corresponding axial securing of the rolling bearings of the second intermediate roller 4.

By means of the guide means 16 and 17, in order to separate the inking and damping units from one another, the second intermediate roller 4 can be changed over either manually or possibly by other adjusting means (not shown), from the first position, in which it engages the bottom intermediate roller 3 and the first ink spreader roller 8, into a second position in which the second intermediate roller 4' is engaged as an over-rider or tandem roller, with separation between the rollers 3 and 4. In this position, the second intermediate roller 4', as well as the first intermediate roller 3 engage the applicator roller 2 of the damping unit.

In the drawings the references relating to the second position of the second intermediate roller 4' and its associated parts each have been designated with a prime character.

The drive mechanism for axially reciprocating the first intermediate roller or the first and second rollers of the intermediate roller pair 3, 4 of a combined damping and inking unit can be best understood upon reference to FIGS. 3 to 6.

The end of the spindle 13 at each end of the intermediate roller 3 is received, with the interposition of a roller lock 26 and a linear ball bearing 34, in a bearing socket of the first bearing lever 10, the bearing socket being open on one side. The roller lock 26 is embodied by an entraining member 27 which is unitary with the linear ball bearing 34 and which can be introduced, together with the spindle 13 carrying the roller 3, through a slot 28 into the bearing socket of the first bearing lever 10. The member 27 is secured in the bearing socket by rotation. The shell of the first roller 3 is rotatably mounted on the spindle 13 with the interposition of rolling bearing means as is conventional. The pivoting lever 9 has a narrow web 25 and towards the second roller 4 a considerably wider web 24. The narrow web 25 is of thickness Y and the wide web 24 is, as illustrated, of thickness X.

In keeping with the present invention, two coupling parts 23 are pinned to the spindle 13 of roller 3 in the pivoting range of the lever 9 and at a separation from one another corresponding to the size of the wide web 24 of the lever 9. With respect to the center of the spindle 13, the coupling parts 23 have a long portion A and a short portion B such that, when the second roller 4 is in the connecting position between the damping unit and the inking unit, the narrow web 25 of the lever 9 is disposed between the coupling parts 23 in portion B thereof. Conversely, when the second roller 4' has been changed over into its tandem position on the damping roller 2 and separated from the inking unit, the wide web 24 is disposed in an accurate fit between the coupling parts 23 in portion A thereof.

Pursuant to the invention, a stroke coupling between the spindle 13 of the first intermediate roller. 3 and the first ink spreader roller 8 is provided by way of a line of drive comprising two spreader links 36 and 47 which reduce the axial stroke of the roller 8 to a predetermined stroke ($a_o$) of the spindle 13 of the first intermediate roller 3.

The ink spreader roller 8 is driven axially in known manner by way of a drive tube 38, a drive lever 40 and a drive roller 39 running in a link 37. The drive line embodied by the two links 36 and 47 comprises a pivotable cam follower lever 36 and an axially movable thrust rod 47, the lever 36 sliding in a wide slot 44 in the damping unit transmission casing 41 around a pin 42. At one end the lever 36 has an entraining roller 35 guided in the link 37 on the roller 8 while at its other end the lever 36 is pivotally born for rotation on the casing 41 by way of a pin 42. Thrust rod 47 is pivotally connected to the lever 36 by way of a first entraining connection 43, 45, 46 and 48, is guided axially in the direction of spindle 13 of the roller 3 by the side walls 32 by way of a linear ball bearing 52, and is pivotally connected by way of a second entraining connection 49, 50 and 51 to the beginning of the spindle 13. The first entraining connection 43, 45, 46 and 48 has on the entraining member 43 a pin-like part 46 which is rotatably mounted in the lever 36 and has a prismatic part 48 sliding in a slot 45 in rod 47. The second entraining connection 49–51 has a prismatic part 51 on the second entraining member 49, the part 51 being slidable in a transverse slot 50 in the spindle 13.

In further accordance with the invention, the spacing $b_o$ between the pivot point of the part 46 and the pivot point of the pin 42 is chosen in accordance with the required stroke step-down $a_o$. Also, the difference between the thickness Y of the narrow web 25 and the thickness X of the wide web 24 of the lever 9 is less than twice the stroke $a_o$ of the spindle 13 of the roller 3 while the distance between the coupling surfaces of the two coupling parts 23 corresponds to the thickness X of the wide web 24.

From the foregoing, it will be appreciated that when the second intermediate roller 4 is in the position interconnecting the inking unit and the damping unit, the narrow web 25 of the lever 9 is disposed between the two coupling parts 23 in the zone B. Since axial movement of spindle 12 of intermediate roller 4 including the levers 10 and 11 is prevented by such spindle bearing laterally on the press side walls 32, the first intermediate roller 3 makes its axial stroke $a_o$ without affecting the movement of the roller 4. When the second intermediate roller 4' is in its tandem roller position as an overrider roller on the damping roller 2, the axial stroke $a_o$ is transmitted from the spindle 13 to the spindle 12' due to the absence of axial clearance between the coupling surfaces of the parts 23 and the wide web 24 of the lever 9, the second roller 4' not being secured against axial movement in this position. This leads to a parallel spreading action, not previously known, of two rider rollers on the damping roller 2 with a stroke $a_o$ which is reduced as compared with the stroke of the spreader roller 8 without the likelihood of disturbance, since the reduced stroke is derived directly from the stroke of the ink spreader roller 8.

When the intermediate rollers 3 and 4' are positioned separately from the inking unit, a connection between the same and the damping unit can be restored by means of a third roller 33 in the position of the second roller 4 without any need to pivot the second roller 4' back into its initial position. To this end, the third intermediate roller 33 is received in a parking position between the press side walls 32 and is used to replace the changed-over second roller 4 only when used in the lever 11. The roller 33 is then mounted without a pivoting lever 9 on the spindle 13 since it merely needs to be removed from the roller lock 15 to be parked in the damping unit when not in use. When installed in the roller lock 15, the third intermediate roller 33 enables a connection to be established between the damping unit and the inking unit and enables both the first and second intermediate rollers 3 and 4' to be disposed in spreading engagement on the damping roller 2.

We claim as our invention:

1. A drive mechanism for selectively axially reciprocating at least a first roller of first and second rollers in an intermediate roller pair of a combined damping and inking unit in an offset printing press comprising:

a press frame, a plate cylinder, an inking unit including an ink spreading roller for inking said plate cylinder, a damping unit including a damping roller for damping said plate cylinder, means for mounting said plate cylinder and said inking and damping units on said press frame, means for axially reciprocating said ink spreader roller, pairs of first and second bearing levers pivotable around the center of said ink spreader roller and which bear axially against one another and said press frame, first and second intermediate rollers each having a spindle with opposed ends, each end of said first intermediate roller spindle being received in a linear bearing at an end of one of said first bearing levers, each end of said second intermediate roller spindle being received at an end of one of said second bearing levers, first lock means for securing each end of said second intermediate roller spindle to said second bearing levers, means including a pair of swing levers each having one end pivotally connected at one end of said first intermediate roller spindle and having another end for receiving said second intermediate roller spindle, second lock means for securing each end of said second intermediate roller spindle to said swing levers, said swing levers having guide means for guiding said second intermediate roller between a first position, in which it is engagement with said first intermediate roller and with said ink spreader roller, and a second position, in which said second intermediate roller is pivoted away from said first intermediate roller and together therewith engages, as a tandem rider roller, with said damping roller, said swing levers each having narrow web and, in the direction of said second intermediate roller, a substantially wider web, two coupling parts secured to each of said ends of said first intermediate roller spindle at a spacing (X) corresponding to the thickness of said wider web of said swing levers.

said coupling parts having, with respect to a center of said first intermediate roller spindle, a long portion (A) and a short portion (B) such that, when said second intermediate roller is in its first position between and interconnecting said first intermediate roller and said ink spreader roller, each said narrow web is disposed between said coupling parts in said short portion (B) thereof, and when said second intermediate roller is in said second position engaging aid damping roller, each said wider web of said swing lever is disposed in a close fit between said coupling parts in said long portion (A) thereof, and drive line means coupling said first intermediate roller spindle with said ink spreader roller including two spreading links which step down an axial stroke of said ink spreader roller to a predetermined axial stroke ($a_o$) of said first intermediate roller spindle.

2. A drive mechanism according to claim 1, characterized in that said drive line means of said spreading links comprises a pivotable cam follower lever and an axially movable thrust rod, said cam follower lever having a cam roller at one end engaging said ink spreader roller, and said thrust rod being connected by way of a first connection at a fulcrum to said pivotable cam follower lever and being connected by way of a second connection to an end of said first intermediate roller spindle.

3. A drive mechanism according to claim 2, including a transmission casing for said damping unit, said cam follower lever being pivoted at a fulcrum by way of a pin on said transmission casing, and the distance ($b_o$) between the fulcrum of said first connection of said cam follower lever and the fulcrum of said pin on said casing being selected in accordance with said predetermined stroke ($a_o$).

4. A drive mechanism according to claim 2, characterized in that the difference between the thickness (Y) of said narrow web and the thickness (X) of said wider web of said swing lever is less than twice said predetermined stroke ($a_o$) of said first intermediate roller spindle.

* * * * *